US005289600A

United States Patent [19]

Schermel

[11] Patent Number: 5,289,600

[45] Date of Patent: Mar. 1, 1994

[54] MATTRESS BASE ASSEMBLY KIT

[75] Inventor: William Schermel, Mississauga, Canada

[73] Assignee: Halcyon Waterbed Inc., Downsview, Canada

[21] Appl. No.: 22,921

[22] Filed: Feb. 26, 1993

[30] Foreign Application Priority Data

Jan. 11, 1993 [CA] Canada ..... 2087071

[51] Int. Cl.[5] ..... A47C 19/00

[52] U.S. Cl. ..... 5/400; 5/201; 5/285; 5/907

[58] Field of Search ..... 5/400, 201, 200.1, 174, 5/202, 451, 285, 907

[56] References Cited

U.S. PATENT DOCUMENTS

| | | | |
|---|---|---|---|
| 3,100,304 | 8/1968 | Brandlin et al. | 5/174 |
| 3,736,605 | 6/1973 | Klein, Jr. | 5/401 |
| 3,761,970 | 10/1973 | Fredman | 5/201 |
| 4,160,296 | 7/1979 | Fogel | 5/400 |
| 4,186,452 | 2/1980 | Underwood | 5/400 |
| 4,391,008 | 7/1983 | Yamaoka et al. | 5/200.1 |
| 4,507,815 | 4/1985 | Danko | 5/400 |
| 4,675,929 | 6/1987 | Santo | 5/400 |
| 4,788,727 | 12/1988 | Liu | 5/174 |
| 5,144,706 | 9/1992 | Walker | 5/400 |

*Primary Examiner*—Alexander Grosz

*Attorney, Agent, or Firm*—Riches, McKenzie & Herbert

[57] ABSTRACT

A kit is provided for assembly of a mattress supporting base comprising: a frame having a top mattress supporting platform, the platform being supported by a plurality of spaced apart longitudinal stringers, each stringer having a series of longitudinally spaced apart openings, the openings being transversely aligned thus defining a series of continuous passageways through said stringers across the assembled width of the frame; a plurality of transverse beams each engagable in an associated one of said passageways; and a plurality of leg means, downwardly protruding from each of said beams.

10 Claims, 5 Drawing Sheets

MATTRESS BASE ASSEMBLY KIT

FIELD OF THE INVENTION

The invention relates to a mattress supporting base assembled for use from a kit of components and which components may be nested together in a compact package for ease of storage and transport.

BACKGROUND OF THE INVENTION

Conventional beds generally include a mattress supported upon a box spring, a wooden bed frame or both. Box springs are generally designed to have the outward appearance of a mattress, being covered in quilted fabric and cushioning for example. Generally, box springs have a wooden rectangular frame supporting an array of springs to provide firm support for the mattress.

Bed frames may simply support a mattress on boards spanning between side rails of the frame, or may accomodate a box spring. Bed frames conventionally have a head board, a foot board and two side rails, and are constructed to be easily assembled and disassembled.

A box spring is typically constructed in one piece of the same dimensions as the mattress it supports. Legs are provided with embedded threaded metal rods to be screwed into threaded inserts in the bottom of the box spring frame, when the box spring is used without a bed frame. In use, the legs often work loose destabilizing the box spring, or damaging the wooden box spring frame. As a result such screw-in box spring legs are totally unsuitable for use with heavy hybrid waterbed mattresses.

Alternatively, if the box spring does not have its own legs, a relatively expensive nine-leg metal platform is used under the box spring. The metal frame represents an additional expense, however the increased strength and stability of a metal frame, especially when casters are used, are necessary and justifiable in many cases. The metal platform results in an inferior unsightly appearance. The platform's metal rails may protrude beyond the bed creating a safety hazard and exposing bed linens to possible damage. However due to the increased load bearing capacity of metal frames, they are used extensively to support waterbeds and a high percentage of conventional spring beds.

A conventional box spring, due to its stiff wooden frame, is often heavy and awkward to handle, especially the larger "king size" or "queen size" variety. Moving such box springs, in apartment elevators and around corners into bedrooms for example, is often difficult and exposes the box spring and doorways to potential damage.

The use of waterbed mattresses dictate that bed frames and box springs have greatly enhanced load bearing capacity due to the weight of the water enveloped in the waterbed bladders. Hybrid waterbed mattresses are increasingly used in which water filled bladders are embedded in foam cushioning encased in an external quilted fabric. The hybrid waterbed mattress therefore has the outward appearance and many functional characteristics of a conventional spring or foam mattress, but is of much greater weight. Hybrid waterbed mattresses are constructed with outer dimensions identical to conventional spring mattresses, which contributes much to their marketplace acceptance.

Waterbeds, including hybrid types, suffer from the disadvantage that, due to increase strength requirements, the waterbed frames are necessarily heavier than conventional bed frames. Waterbed frames appear bulky and are different in appearance from conentional bed frames which impedes their marketplace acceptance.

Due to their weight, hybrid waterbeds commonly use the nine-leg metal platform described above. The metal platform and legs provide the required support in comparison to the inadequate screw-in legs of a wooden frame box spring.

SUMMARY OF THE INVENTION

The invention overcomes the above disadvantages of conventional mattress supporting bases and box springs in the provision of a kit which may be easily assembled and disassembled to contruct a mattress supporting base. Since the base is constructed of components, it is more easily transported and stored than conventional bases.

The kit in the preferred embodiment includes two frames which are assembled together side to side to form a mattress supporting platform. The frames are designed as mirror images and are given an exterior fabric treatment to emulate a conventional box spring. The base may be disassembled into two equal halves which are easier to transport and store than a one-piece base.

The invention is especially advantageous when used to support a hybrid waterbed mattress. The base may be of heavy construction having adequate strength to support the water-filled hybrid mattress, but is easily handled when disassembled into smaller components. The invention provides an aesthetically pleasing appearance similar to a box spring with wooden legs, in contrast to the unsightly metal frames and metal legs conventionally used. The added expense and safety concerns associated with the use of a nine-leg metal frame are also avoided by use of the invention.

The components of the kit are designed such that they may be nested together in a compact package of approximately one half the size of a conventional base. Therefore storage space requirements and shipping bulk are reduced.

As described in detail below the invention provides a kit for assembly of a mattress supporting base comprising: a frame having a top mattress supporting platform, the platform being supported by a plurality of spaced apart longitudinal stringers, each stringer having a series of longitudinally spaced apart openings, the openings being transversely aligned thus defining a series of continuous passageways through said stringers across the assembled width of the frame; a plurality of transverse beams each engagable in an associated one of said passageways; and a plurality of leg means, downwardly protruding from each of said beams.

BRIEF DESCRIPTION OF THE DRAWINGS

In order that the invention may be readily understood, a preferred embodiment of the invention will be described, by way of example, with reference to the accompanying drawings in which:

FIG. 2 shows the kit in a compact package for shipping and storage;

FIG. 3 shows the package opened with the first frame disengaged from the second frame, and three beams nested in the interior cavity of the second frame;

FIG. 4 shows the three transverse beams assembled to the first frame with the second frame positioned for assembly upon the beams; and FIG. 5 shows the base completely assembled with the first and second frames side by side.

DETAILED DESCRIPTION OF A PREFERRED EMBODIMENT

Figure 5:
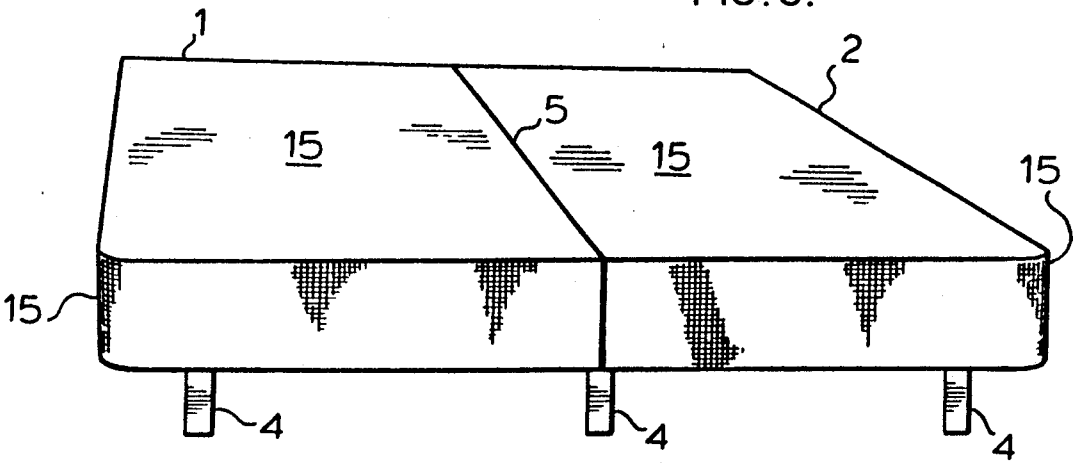

A mattress supporting base is illustrated in FIG. 5 which is assembled from a kit according to the invention. The base emulates the appearance of a conventional box spring with a flat top surface for supporting a mattress, quilted fabric on the side surfaces, and supporting legs 4 to elevate the base. A first frame 1 and a second frame 2 are adapted for side to side assembly along a central longitudinal joint 5.

Figure 1:
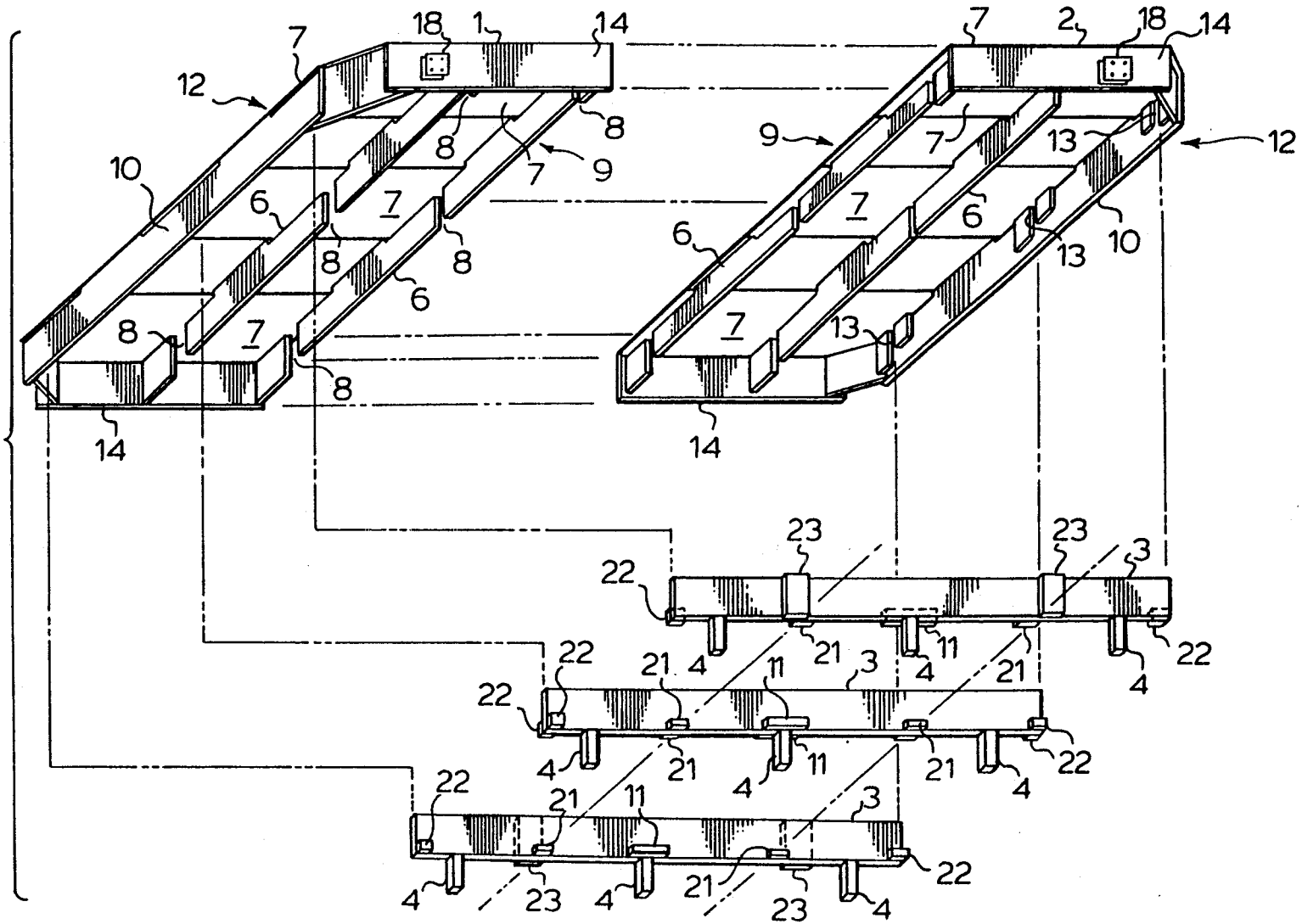
FIG. 1 is an exploded isometric view of a base constructed of two frames (with quilting removed) showing the placement of three transverse beams into slotted openings in the longitudinal stringers.

As shown in FIG. 1, transverse beams 3 are inserted into slotted openings 8 in longitudinal stringers 6 of each frame 1 and 2. The stringers 6 support panels 7 which form a top mattress supporting platform. Each beam 3 includes legs 4.

In the assembled state therefore, the transverse beams 3 span between the two frames (1, 2) and secure the frames (1, 2) together into a rigid base. The beams 3 and stringers 6 interlock together forming a grillage to support the platform. The legs 4 are securely attached to the beams 3, with rabbet joints for example, providing increased stability over the conventional box spring leg design described above.

FIG. 1 shows the frames (1, 2) with exterior quilted fabric and padding removed to clearly reveal their structure. It will be apparent that the frames (1, 2) may be fabricated using relatively inexpensive particle board members with minimal woodworking equipment. The beams 3 also may be made of particle board and legs 4 of solid wood.

The resulting base therefore can be designed to accomodate the heavy loads of a hybrid waterbed mattress using inexpensive materials, simple woodworking equipment and relatively low labor requirements. Since such waterbed bases are sturdy and heavy, the invention may be used advantageously in the form of FIG. 1 where such a heavy base may be handled in two frame components of managable weight.

Figure 3:
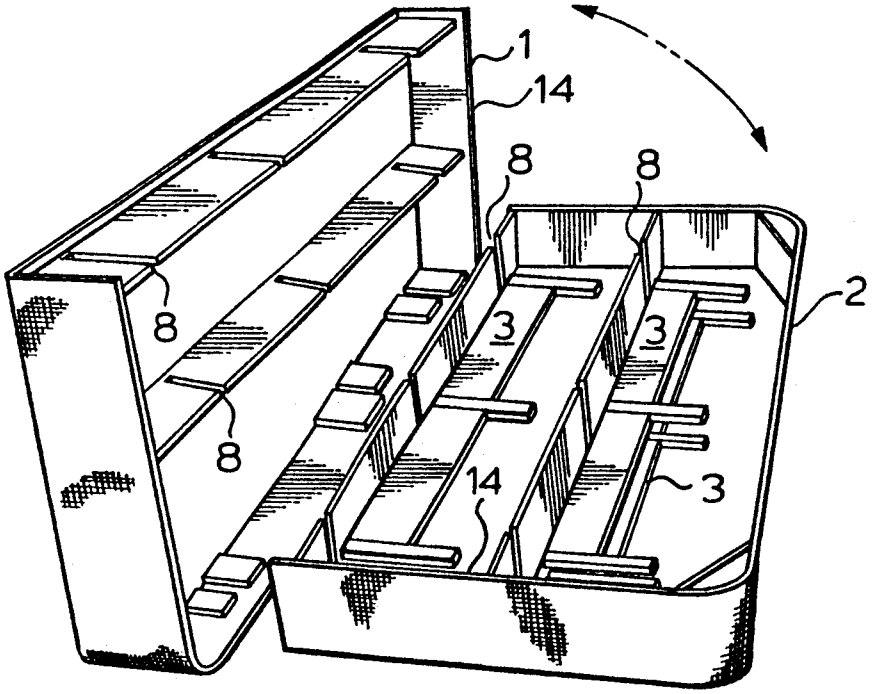
FIGS. 2 to 5 are perspective views illustrating the sequence of assembly of a mattress supporting base from a compact nested package as follows.
Figure 2:
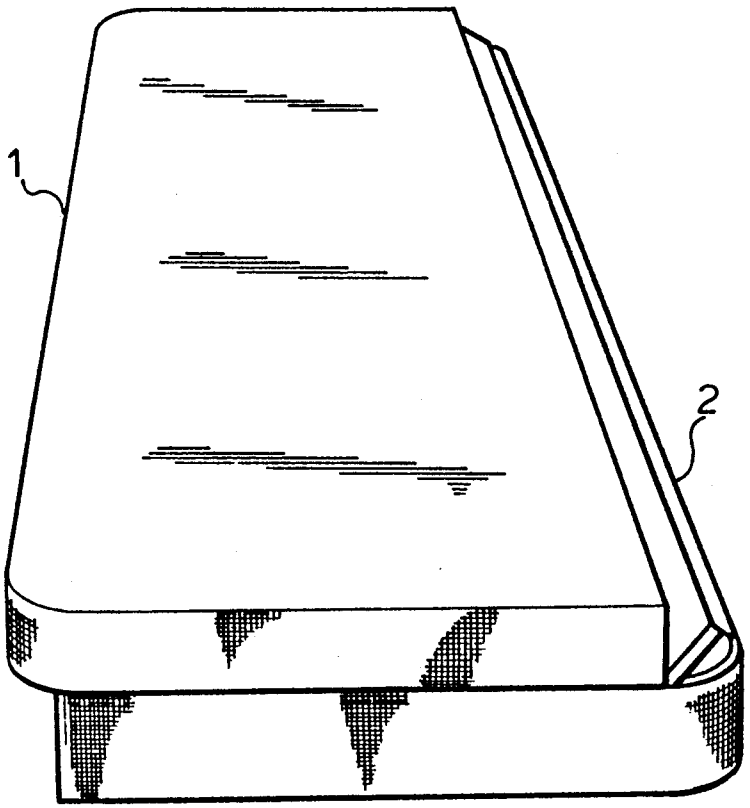
Figure 4:
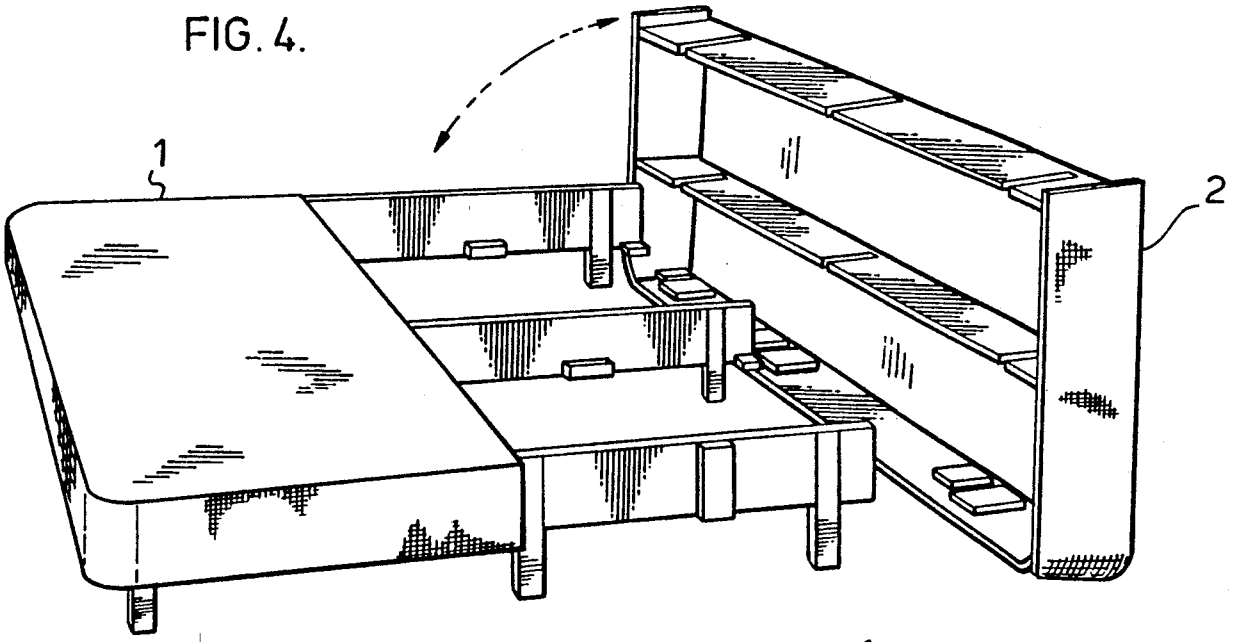

When used to support large size conventional or hybrid waterbed mattresses, the nesting of the frames (1, 2), as demonstrated in FIGS. 2 and 3, reduces the width of the package to be handled and stored.

The secure joining of the legs 4 to the beams 3 eliminates the instability of conventional screw-in threaded legs in box springs. For example, the alternative base shown in FIG. 7, may be used to support a single size mattress of relatively narrow width on a single frame 1. The use of beams 3 with securely attached legs 4 provides increased stability over a conventional box spring leg design. Such stability is especially important in supporting heavy waterbed mattresses. However any type of bed requires a high degree of stability to ensure safe use and long service life.

Figure 6:
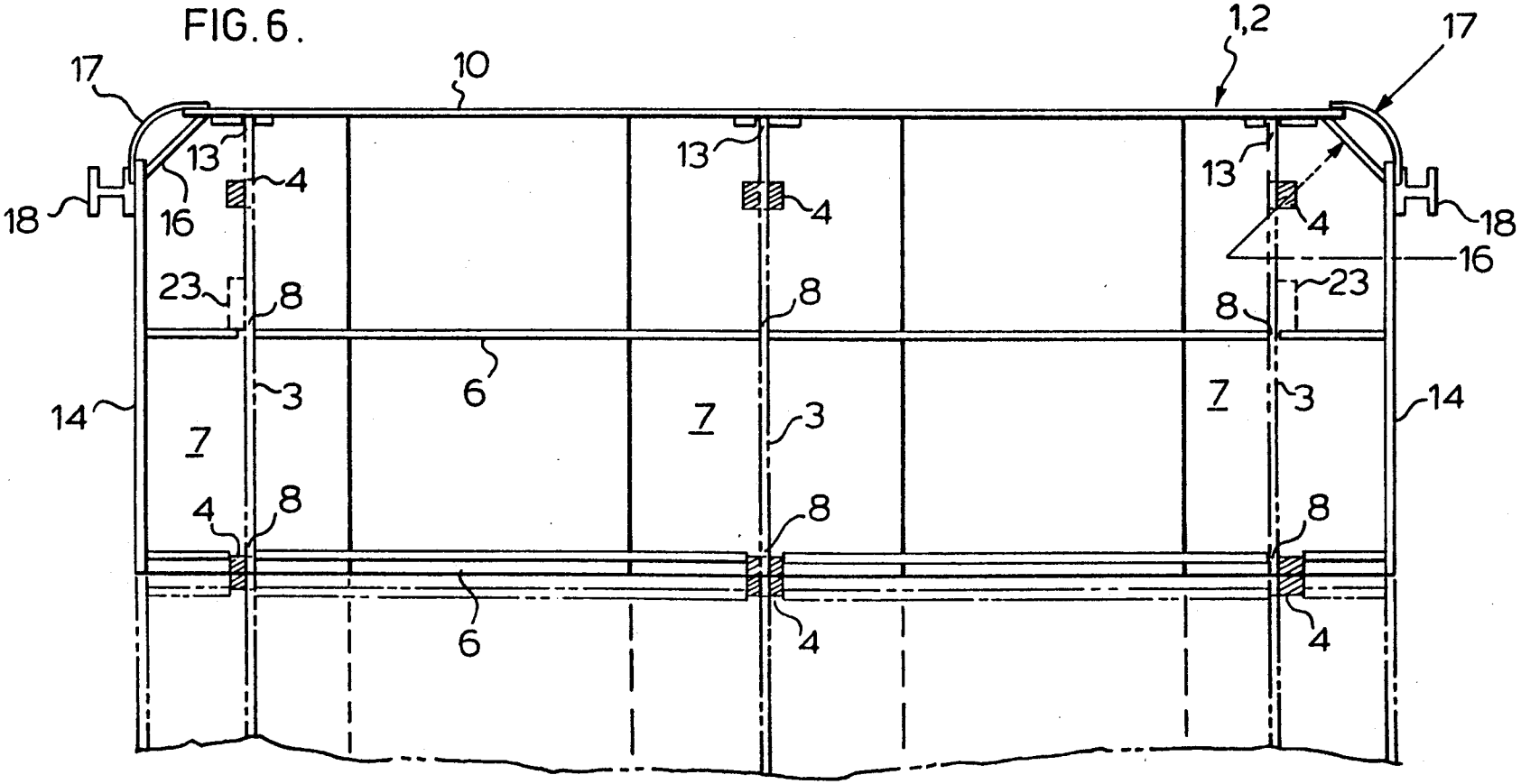
FIG. 6 is a bottom plan view of a frame showing the details of a preferred construction.
Figure 7:
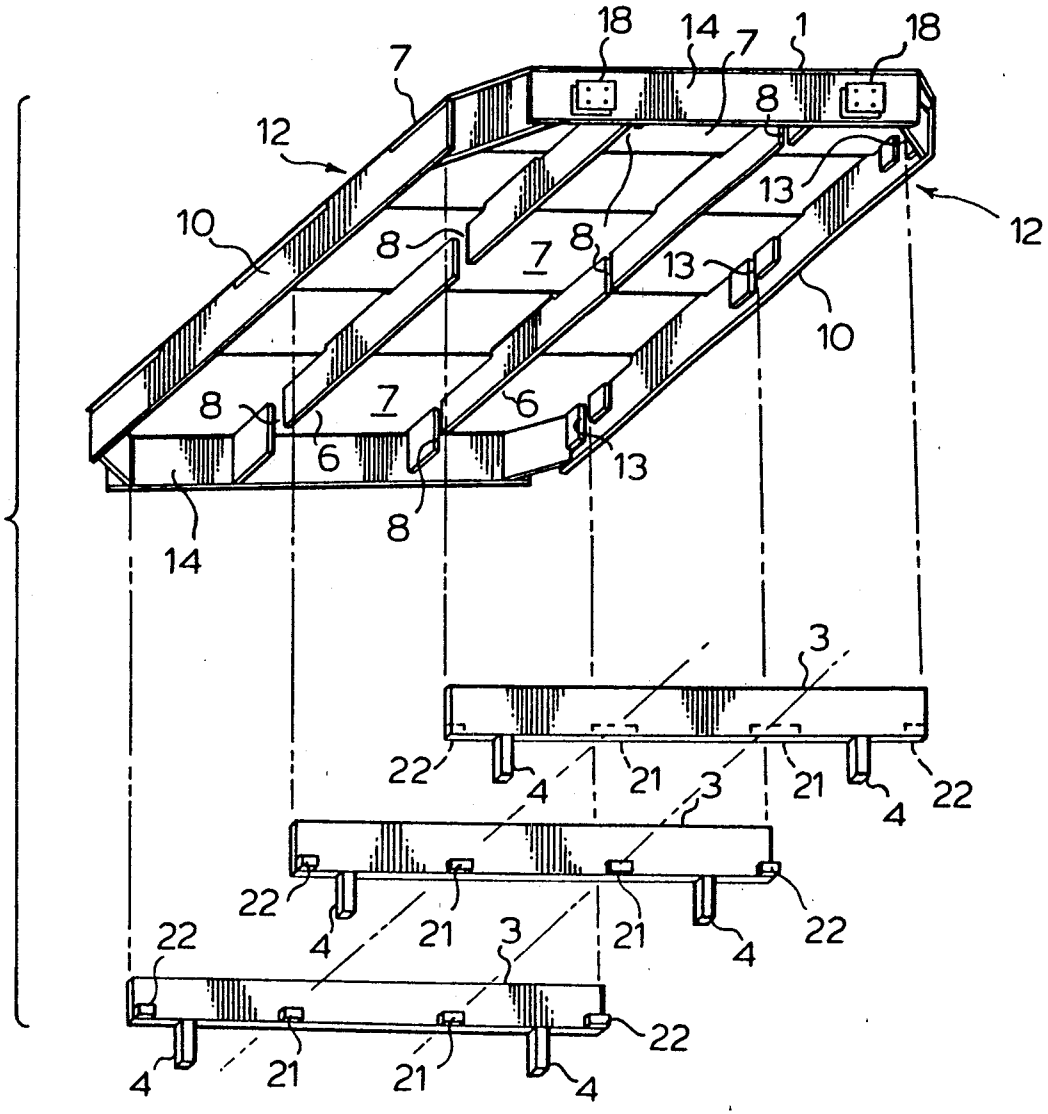
FIG. 7 illustrates a second embodiment where a single frame with supporting beams and legs is used.

In accordance with the invention, the kit for assembly of a mattress supporting base may include a single frame (1 as shown in FIG. 7) or two frames (1 and 2 as shown in FIG. 1). The choice of design depends on a variety of factors such as the size, weight and load capacity required or the need to reduce the bulk of units shipped or stored. It will be understood that although the description below and FIGS. 1–6 relate to a double frame design, the invention also includes the single frame embodiment as shown in FIG. 7.

Each frame (1, 2) has a top mattress supporting platform made of particle board panels 7. The platform is supported upon longitudinal stringers 6 which are laterally spaced across the width of the frame (1, 2). Each stringer 6 has series of longitudinally spaced apart openings 8, as shown in the form of downwardly open rectangular slots 8. The openings 8 are aligned in transverse planes to define a series of continuous passageways through the stringers 6.

When a kit includes two frames (1, 2), the frames (1, 2) are each adapted for side to side assembly along an abutting inside edge 9 of each frame (1, 2). The upper surfaces of the platforms of each frame (1, 2) lie in a common plane. When assembled together side by side, the openings 8 define a series of three continuous passageways across the combined assembled width of the frames (1, 2).

In each passageway, a transverse beam 3 is inserted, as shown in FIG. 1. The beams 3 span between the side to side assembled frames (1, 2) and secure the frames (1, 2) together. Downwardly protruding legs 4 extend from each beam 3 to elevate the base.

Support blocks 11, and 21 are attached to the lower edge of the beams to support the bottom of the stringers 6. At the ends of the beams 3 an end block 22 supports the outside edge members 10. As shown in FIG. 1, the head and foot beams 3 are identical having blocks 11 and 21 on their inward vertical faces. The central beam has blocks 11 and 21 on both faces. To accomodate the height of the blocks 11 and 21, the stringers 6 are reduced in height in their central regions between the head and foot beams 3. The outward ends of the stringers engaging the end members 14, are full height and are not directly supported by the beams 3. In an assembled mattress supporting base therefore, the support blocks 11 are downwardly adjacent to and supportably engaged with the horizontal bottom surface of the associated stringer 6.

Clamping blocks 23 are provided on the head and foot beams 3 to engage the outward face of the interior stringer 6. Therefore the first and second frames (1, 2) are prevented from separating by positive engagement of the inner face of the clamping blocks 23 and the outward face of the interior stringer 6. In an assembled mattress supporting base, the clamping blocks 23 are laterally outwardly adjacent to and engaged with the outward surfaces of the associated stringer 6.

In the areas adjacent the openings 8 in the stringers 6 additional reinforcing may be provided by adding a second underside layer of panels 7 or by increasing the panel 7 thickness in such areas. For example, the entire top surface of each frame (1, 2) is covered with ¼ inch wafer board panel 7, and in such reinforced areas a second ¼ inch wafer board panel 7 is placed on the underside of the top board 7. As shown in FIGS. 1 and 7, the stringers 6 and outside edge members 10 are notched to accomodate the reinforcing panels 7. If a single thickness of wafer board was used, such notching is not required.

Each frame (1, 2) also has at least one longitudinal outside edge member 10 along an outside edge 12 of the frame (1, 2). The outside edge members 10 each have a series of longitudinally spaced apart inwardly open sockets 13. The sockets 13 are defined by two adjacent blocks, in the embodiments illustrated, and are transversely aligned with an associated passageway. The extreme ends of the beams 3 engage the sockets 13 in the assembled base.

In the illustrated embodiments, the stringers 6, beams 3, and edge members 10 are rectangular boards. Accordingly the openings 8 and sockets 13 are downwardly open rectangular slots. Other configurations of members and slots may be used within the teaching of the invention but to lesser advantage. As illustrated in FIG. 1, each frame (1, 2) has a rectangular platform of panels 7 with a longitudinal outside edge member 10, a stringer to adjacent the inner edge 12, and two end members 14 thus defining a downwardly open rectangular cavity.

Refering to FIGS. 2 and 3 the kit may be nested together for compact storage and shipping such that the platforms of each frame (1, 2) lie in parallel planes. The compact packaged kit of FIG. 2 may be wrapped in protective paper or plastic shrinkwrap material for transport. In the nested configuration an end member 14 of each frame (1, 2) is engaged in an end passageway (slots 8) of the other frame (2, 1). Since the beams 3 are of a length less than the longitudinal dimension of the frame cavities, the beams 3 may be protectively stored within the cavities (as shown in FIG. 3).

As shown in FIG. 5, the exterior surfaces of the outside edge members 10 and end members 14 may be enveloped in quilted fabric and cushioning material 15 to emulate the appearance of a conventional box spring. FIG. 6 shows corner details including a corner reinforcing strut 16 and curved outer cardboard band 17. If desired, the base may also include head board mounting brackets 18 and footboard mounting brackets 18, as shown in FIGS. 6 and 1, upon which conventional head and foot boards may be mounted (not shown).

Although the invention has been described and illustrated in relation to certain preferred embodiments, it will be understood that the invention is not restricted to these embodiments but includes all functional equivalents thereof.

I claim:

1. A kit for assembly of a mattress supporting base comprising:

a frame having a top mattress supporting platform, the platform being supported by a plurality of spaced apart longitudinal stringers, each stringer having a series of longitudinally spaced apart openings, the openings being transversely aligned thus defining a series of continuous passageways through said stringer across the assembled width of the frame, each frame comprising a longitudinal outside edge member, along an outside edge of each frame remote from said inside edge, the outside edge member having a series of longitudinally spaced apart inwardly open sockets, each socket being transversely aligned with an associated one of said passageways and engageable with an extreme end of an associated beam;

a plurality of transverse beams each engageable in an associated one of said passageways; and a plurality of leg means, downwardly protruding from each of said beams.

2. A kit according to claim 1 including a first and a second said frames adapted for side to side assembly along an inside edge of each frame with each frame having a top mattress supporting platform the upper surfaces of which lie in a common plane, the openings in each stringer being transversely aligned thus defining a series of continuous passageways through said stringers across the combined assembled width of the first and second frames, and wherein each beam spans between side to side assembled frames.

3. A kit according to claim 2 wherein the stringers, beams and edge members comprise rectangular boards, and the openings and sockets comprise downwardly open rectangular slots.

4. A kit according to claim 3 wherein each frame comprises a rectangular platform having a longitudinal outside edge member, a stringer adjacent said inside edge, and two end members thus defining a downwardly open rectangular cavity.

5. A kit according to claim 4 wherein the beams are of a length less than the longitudinal dimension of said cavity and wherein the kit can be nested together wherein: the platforms of each frame lie in parallel planes; an end member of each frame is engaged in an end passageway of the other frame; and the beams are stored within the cavities.

6. A kit according to claim 4 wherein exterior surfaces of the outside edge and two end members are enveloped in fabric and cushioning material.

7. A kit according to claim 3 comprising a beam having support blocks downwardly adjacent and supportably engaging the stringers in an assembled base.

8. A kit according to claim 7 comprising a beam having clamping blocks laterally outwardly adjacent and engaging at least one stringer of each frame in an assembled base.

9. A kit according to claim 1 wherein said frame includes head board mounting brackets and foot board mounting brackets.

10. A kit according to claim 1 wherein each of said beams are supported at an elevation upon a plurality of legs, each leg being secured to an associated beam with a rabbet joint.

* * * * *